US005323704A

United States Patent [19]

Fraczek

[11] Patent Number: 5,323,704

[45] Date of Patent: Jun. 28, 1994

[54] DEVICE FOR THE IDENTIFICATION OF A FLEXIBLE ROLLER SHELL

[75] Inventor: Stephen P. Fraczek, Lee, N.H.

[73] Assignee: Heidelberg-Harris GmbH, Heidelberg, Fed. Rep. of Germany

[21] Appl. No.: 922,196

[22] Filed: Jul. 30, 1992

[51] Int. Cl.[5] ..... B41F 13/08; B07C 5/00

[52] U.S. Cl. ..... 101/375; 209/3.3; 209/569

[58] Field of Search ..... 101/375, 376, 379, 477, 101/DIG. 46; 425/909; 209/3.3, 569

[56] References Cited

U.S. PATENT DOCUMENTS

| | | | |
|---|---|---|---|
| 3,920,124 | 11/1975 | Patterson | 209/583 |
| 4,665,824 | 5/1987 | Greiner et al. | 101/DIG. 46 |
| 4,823,693 | 4/1989 | Kobler | 101/375 |
| 5,019,697 | 5/1991 | Postman | 235/492 |
| 5,033,623 | 7/1991 | Grecksch et al. | 209/927 |
| 5,058,500 | 10/1991 | Mizuno | 101/142 |

FOREIGN PATENT DOCUMENTS

| | | |
|---|---|---|
| 3233972 | 5/1983 | Fed. Rep. of Germany . |
| 3908270 | 9/1989 | Fed. Rep. of Germany . |
| 8702416 | 5/1989 | Netherlands . |

*Primary Examiner*—Edgar S. Burr
*Assistant Examiner*—Stephen R. Funk
*Attorney, Agent, or Firm*—Herbert L. Lerner; Laurence A. Greenberg

[57] ABSTRACT

A device for the identification of a roller shell includes a microchip incorporated into a flexible material roller shell for printing presses. A scanning device excites the microchip for emitting signals permitting a definite identification of the microchip and of the roller shell.

6 Claims, 1 Drawing Sheet

DEVICE FOR THE IDENTIFICATION OF A FLEXIBLE ROLLER SHELL

BACKGROUND OF THE INVENTION

1. Field of the Invention

The invention relates to a device for the identification of a roller shell manufactured of flexible material and utilized in printing presses.

2. Description of the Related Art

The monitoring or control of the inventory of rubber blankets or rubber rollers presents a problem, especially in large printing companies. Certainly, the rubber blankets or the rubber rollers carry embossed identification features. However, due to wear and tear the identification features become illegible, as soon as the rubber blankets or rubber rollers have been utilized in a printing process. Since in each case the selection of the rubber blanket or the rubber roller conforms to the respective print parameters, for example of the color, assurance must be provided that the selection of the rubber blanket or the rubber roller is clearly possible at all times. However, this is not always the case in the prior art.

SUMMARY OF THE INVENTION

It is accordingly an object of the invention to provide a device for the identification of a flexible roller shell, which overcomes the hereinafore-mentioned disadvantages of the heretofore-known devices of this general type.

With the foregoing and other objects in view there is provided, in accordance with the invention, a device for the identification of a roller shell, comprising a microchip incorporated into a flexible material roller shell for printing presses, and a scanning device exciting the microchip for emitting or sending out signals permitting a clear or definite identification of the microchip and therefore of the roller shell.

In accordance with another feature of the invention, the microchip is incorporated into a rubber roller and the roller shell is a coating of the rubber roller.

In accordance with a further feature of the invention, the microchip is incorporated into a rubber blanket mounted on the rubber cylinder of a printing press and the roller shell is the rubber blanket.

The inventory of rubber blankets or rubber rollers can be monitored without any difficulties through the use of the clearly identifying features of the microchip. In addition, information may be given regarding the life-span of rubber blankets or rubber rollers, especially when the rubber blankets are utilized several times, such as on different printing presses. Furthermore, the optimal range of application of the rubber blankets or the rubber rollers can be determined in dependence on various print parameters, through the use of the clearly identifying features.

In accordance with an added feature of the invention, the microchip has dimensions, an expansion or an extent in the order of magnitude of $mm^2$.

In accordance with an additional feature of the invention, an identification feature is assigned to the roller shell, and there is provided a computer connected to the scanning device, and a storage system connected to the computer for storing information about the roller shell being made available after inputting the identification feature.

Therefore, the respective data, for example the life-span of the rubber blanket or the rubber roller, or the usefulness thereof for an application in connection with certain printing inks, is stored in the storage system. Signals are released through the scanning device which allows a clear identification of the microchip. For example, each microchip may have an identification feature or number allocated thereto, which is readable on a display feature assigned to the storage system. Additional information about the rubber blanket or the rubber roller, can be stored under this number in the storage system. This information can be called up at any time.

In accordance with a concomitant feature of the invention, the signals being emitted or sent out by the microchip are radio waves being modulated in such a way that in each case, they clearly carry the information regarding the identification feature.

Other features which are considered as characteristic for the invention are set forth in the appended claims.

Although the invention is illustrated and described herein as embodied in a device for the identification of a flexible roller shell, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The drawing is a partly broken-away, diagrammatic, perspective view in combination with a schematic circuit diagram, showing the device according to the invention.

DESCRIPTION OF THE PREFERRED EMBODIMENT

Figure 1:
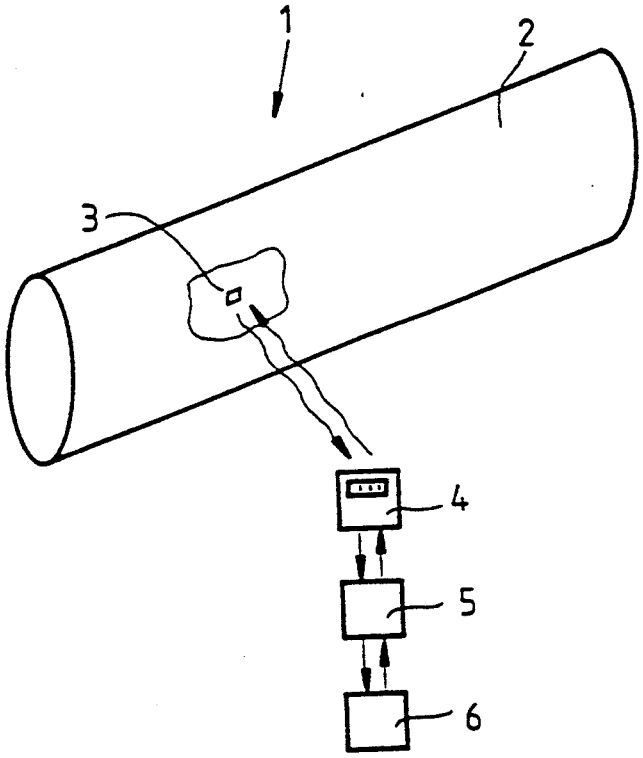

Referring now to the single figure of the drawing in detail, there is seen an illustration of the device according to the invention, being formed of a microchip 3 and a scanning device 4. The microchip 3 is incorporated into a roller shell 2 of a roller 1. The roller 1 is a rubber roller which may be disposed, for example, in the non-illustrated inking unit of a non-illustrated printing press. According to another possibility, the roller shell 2 may be formed of a rubber blanket. In an offset printing press, this rubber blanket is mounted on a rubber blanket cylinder and serves for the transfer of printing images from a plate cylinder to a printed product.

Especially in the case of the placement of the microchip 3 in a rubber blanket, it is provided that the measurements of this microchip 3 are in the dimension of $mm^2$. Due to the small size of the microchip 3, the surface condition of the rubber blanket for the most part remains untouched.

The microchip 3 sends out characteristic signals which allow a clear identification of the microchip 3 and, therewith, of the rubber blanket or the rubber roller, when it is excited by signals of the scanning device 4.

Advantageously, these signals are in the range of radio signals, which also allows an identification over greater distances without interference.

The scanning device 4 can be formed in such a way, that it is connected directly to a computer 5. This computer 5 has a storage system 6 assigned thereto, in which important information regarding the individual rubber blankets or rubber rollers is contained. This information is stored in dependence on the identification feature for each case which is received from the signals of the microchip, and it can be called up by the printer at any time. Possible corrections or additions regarding the information contents may be made without any problem.

I claim:

1. A device for the identification of a roller shell, comprising:

a microchip incorporated into a flexible material roller shell for printing presses, and a scanning device exciting said microchip for emitting signals permitting a definite identification of said microchip and of the roller shell.

2. The device according to claim 1, wherein the roller shell is a coating of a rubber roller.

3. The device according to claim 1, wherein the roller shell is a rubber blanket.

4. The device according to claim 1, wherein the signals emitted by said microchip are radio waves containing information regarding an identification feature of said microchip.

5. The device according to claim 4, wherein said identification feature is assigned to the roller shell; and including a computer connected to said scanning device, and a storage system connected to said computer for storing information about the roller shell made available after inputting the identification feature.

6. In a printing press having a roller with a roller shell formed of a flexible material, a device for the identification of the roller shell, comprising:

a microchip incorporated into the roller shell, and a scanning device exciting said microchip for emitting signals permitting a definite identification of said microchip and of the roller shell.

* * * * *